United States Patent [19]

Dodson

[11] Patent Number: 4,734,953

[45] Date of Patent: Apr. 5, 1988

[54] DUAL BRUSH ASSEMBLY FOR CLEANING BOTH IRON AND WOOD TYPE GOLF HEADS

[76] Inventor: Kenneth E. Dodson, Rte. 1, Box 388, Ridgeway, Va. 24148

[21] Appl. No.: 920,155

[22] Filed: Oct. 17, 1986

[51] Int. Cl.[4] ..... A46B 9/08

[52] U.S. Cl. ..... 15/106; 15/184; 15/DIG. 6

[58] Field of Search ..... 15/106, 169, 184, 210 R, 15/159 A, 200, DIG. 5, DIG. 6

[56] References Cited

U.S. PATENT DOCUMENTS

| | | | |
|---|---|---|---|
| 2,023,275 | 12/1935 | Long | 15/200 X |
| 2,660,183 | 11/1953 | Gruring | 15/169 |
| 2,701,378 | 2/1955 | Reinbolt | 15/184 X |
| 2,744,276 | 5/1956 | Chambless | 15/106 X |

FOREIGN PATENT DOCUMENTS

| | | | |
|---|---|---|---|
| 1145861 | 5/1957 | France | 15/106 |
| 432968 | 4/1948 | Italy | 15/106 |
| 57735 | 11/1911 | Switzerland | 15/184 |

*Primary Examiner*—Peter Feldman

*Attorney, Agent, or Firm*—Rhodes, Coats & Bennett

[57] ABSTRACT

The present invention entails a dual brush assembly specifically designed for cleaning both iron and wood type golf club heads. A small housing structure is provided and within that housing structure a pair of brushes are movably mounted. One brush is a relatively hard brush designed for brushing and cleaning the head of an iron type golf club. The other brush is a relatively soft brush and specifically designed for cleaning the head of a wood type golf club.

4 Claims, 2 Drawing Sheets

DUAL BRUSH ASSEMBLY FOR CLEANING BOTH IRON AND WOOD TYPE GOLF HEADS

FIELD OF THE INVENTION

The present invention relates to brushes and more particularly to golf club head cleaning brushes and still more particularly to golf club head cleaning brushes including dual brushes for cleaning both iron and wood type golf clubs.

BACKGROUND OF THE INVENTION

It is quite common for a golf club head to gather or accumulate dirt, grass and other material while the club is being used. Such accumulations on the golf club head can greatly affect the golfer's performance. For example, a golf club head that is not clean will affect the accuracy of the golfer's shots. In addition the accumulation of dirt, grass and other materials within the grooves of the golf club head will prevent the golfer from placing desired back spin on the golf ball. Therefore, there is a need for the golfer to have the capability of cleaning his or her clubs during the course of playing golf.

In the past there has not been provided a very effective and efficient golf club head cleaning apparatus that is specifically designed for cleaning both iron and wood type golf clubs. This is especially a concern since the two types of clubs require a different cleaning instrument. In this regard, to clean an iron, it is necessary for the cleaning instrument to be relatively hard and sturdy in order to effectively clean dirt, debris and grass from the groves of the iron head. By the same token it is necessary for the cleaning apparatus to provide a relatively soft and gentle cleaning structure for cleaning the wood type heads because of the possibility of scratching the face of the wood type head.

Therefore, there has been and continues to be a need for a golf club head cleaning apparatus that is specifically designed to accomodate the needs for cleaning both iron and wood type golf club heads.

SUMMARY AND OBJECTS OF THE INVENTION

The present invention entails a golf club head cleaning apparatus that is specifically designed to clean both iron and wood type golf club heads. In particular, the golf club head cleaning apparatus of the present invention comprises a small dual brush structure that can be carried by the golfer during the course of actually playing golf. Structurally the cleaning apparatus comprises a pair of independent brushes movably mounted with a housing structure. The pair of brushes include a first relatively hard brush for cleaning iron heads and a second relatively soft brush for cleaning wood heads. Both brushes are movable independently of each other and are movable from an enclosed position within the housing to an extended exposed position where the respective brushes can be used to engage and clean a particular golf club head.

It is therefore an object of the present invention to provide a brush assembly for cleaning both iron and wood type golf club heads.

A further object of the present invention resides in the provision of a brush assembly that includes a pair of brushes with each brush being movable independently of the other and designed to clean either an iron type golf club head or a wood type golf club head.

Still a further object of the present invention resides in the provision of a dual brush assembly of the character referred to above for cleaning golf club heads wherein one brush is relatively hard and designed for cleaning irons while the other brush is relatively soft and designed for cleaning wood heads.

Another object of the present invention resides in the provision of a golf club head cleaning apparatus that is relatively small and compact and which can be easily and conveniently carried by the golfer.

Another object of the present invention is to provide a golf club head cleaning apparatus of the character referred to above that is provided with means for allowing the user to move either of the dual brushes from a retractive position to an exposed position by simply pressing an actuator with his or her thumb.

Other objects and advantages of the present invention will become apparent and obvious from a study of the following description and the accompanying drawings which are merely illustrative of such invention.

GOLF CLUB HEAD CLEANING APPARATUS

With further reference to the drawings the cleaning apparatus of the present invention is shown therein and indicated generally by the numeral 10. Before beginning a detailed description of the present invention it should be emphasised and pointed out that the present invention presents a cleaning apparatus 10 that is specifically designed for cleaning golf club heads, both of the iron and wood type.

Figure 1:
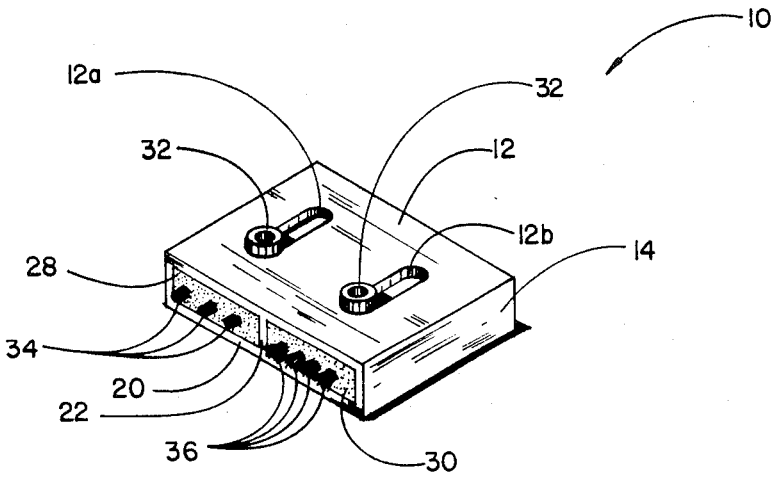
FIG. 1 is a perspective view of the golf club head cleaning apparatus of the present invention with the brushes thereof assuming the exposed position.

Viewing FIG. 1, it is seen that the cleaning apparatus of the present invention includes a generally enclosed housing structure that is formed by a top 12, a pair of side edges 14 and 16, a back edge 18, and a bottom 20. Secured between top 12 and bottom 20 is a partion 22 that effectively forms two cavities 24 and 26 within the housing. It is thusly appreciated that the housing structure is generally enclosed except for the openings formed opposite back edge 18. This open structure forms two access openings to the respective cavities 24 and 26.

Figure 2:
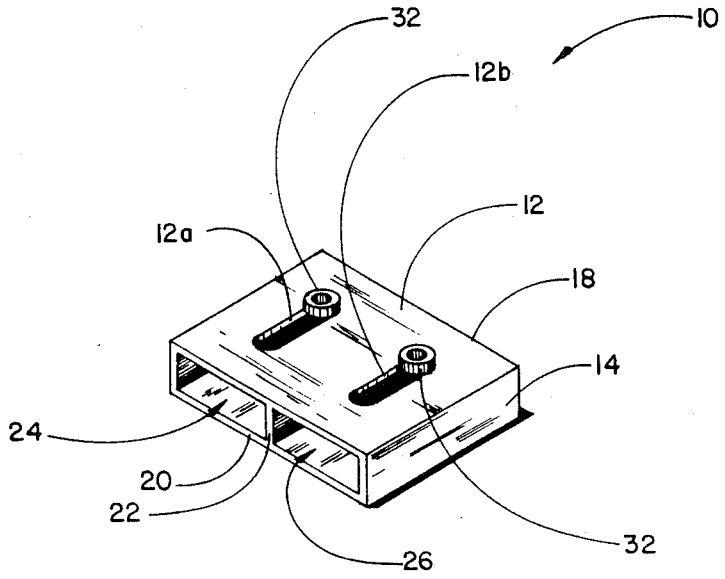
FIG. 2 is a perspective view of the same cleaning device with the brushes shown in the retractede, non-exposed postion.
Figure 3:
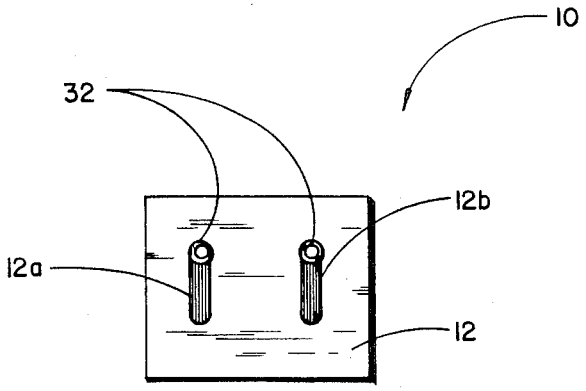
FIG. 3 is a top plan view of the cleaning apparatus of the present invention.

Movably mounted within cavities 24 and 26 is a pair of brush carriers 28 and 30. Respective carriers 28 and 30 are movable back and forth within the cavities 24 and 26 between an extended operative position, FIG. 1, and retracted or inoperative position as shown in FIG. 2.

Secured to each carrier 28 and 30 is a thumb stud 32 that projects upwardly from a respective carrier and extends through a pair of elongated slots **12*a* and 12*b* form and in top 12. Consequently, it can be seen that the carriers 28 and 30 can be moved back and forth within the housing structure by pushing the respective thumb stud 32 back and forth within the respective slots 12***a* and 12*b*.

Secured within the front or exposed edges of carriers 28 and 30 are brush means for cleaning the head of golf clubs. In particular, brush carrier 28 is provided with a relatively hard brush 34 for cleaning irons, particularly the head of iron golf clubs. It is important that these brushes, referred to by the numeral 34, be relatively hard in order that the face and grooves of the iron golf club head can be effectively cleaned. In the present disclosure it is contemplated that the relatively hard brushes 34 would be made from brass or other suitable hand material.

Figure 4:
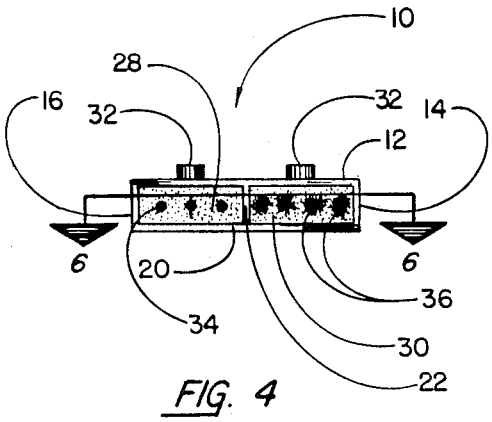
FIG. 4 is a front edge elevational view of the cleaning apparatus of the present invention particularly showing the dual brushes.
Figure 5:
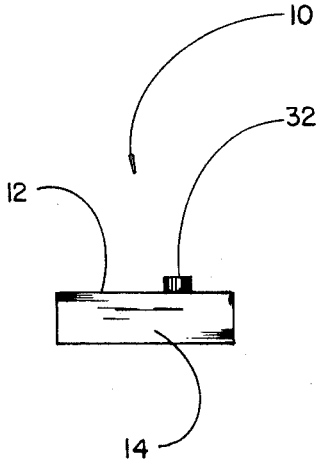
FIG. 5 is a side elevational view of the cleaning apparatus of the invention illustrating the side structure of the same.
Figure 6:
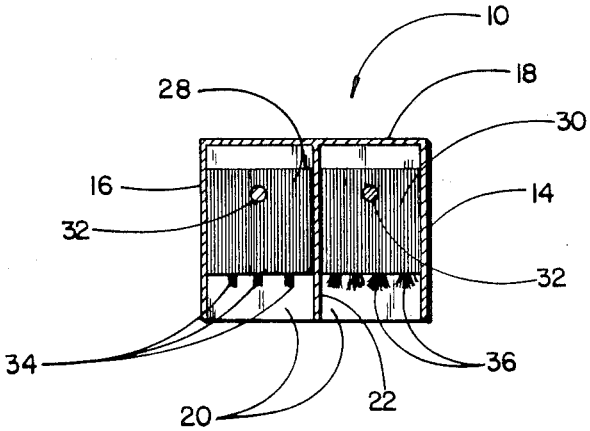
FIG. 6 is a sectional view taken along the line 6—6 of FIG. 4.

Now viewing the other carrier 30, the same is provided with a relatively soft brush assembly 36. It is seen that this relatively soft brush assembly extend from the outer exposed edge of the carrier as viewed in FIGS. 1, 4 and 6. These relatively soft brushes 36 are specifically designed to clean the face of wood golf clubs. In the present enclosure it is contemplated that the relatively soft brushes 36 would be of a soft nylon or nylon type material to assure that the wood head is not scratched or scarred during the cleaning process.

It is appreciated from the foregoing description and discussion that the dual brushes can be actuated independently of each other. This of course means that while an iron type golf club head is being cleaned that the relatively hard brushes 34 would be disposed in an exposed position while the relatively soft brushes 36 would remain in a retracted position. By the same token when the cleaning apparatus 10 of the present invention is used to clean a wood type golf club head, carrier 30 is disposed in the exposed and extended position while carrier 28 assumes a retracted position within the housing.

Throughout this disclosure there has been reference made to cleaning a golf club head. It is appreciated that this refers to cleaning the face of the golf club head.

From the foregoing specification and discussion it is seen that the present invention presents a very effective and efficient cleaning apparatus for cleaning golf club heads of both the iron and wood type. The structure called for is relatively simple and easy to manufacture while still being durable and reliable. In addition, the entire cleaning apparatus is compact and can be carried on the person of the golfer or can be carried in the golfer's bag.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A dual brush golf club head cleaning apparatus having dual separate brushes for cleaning golf club heads of both the iron and wood type, comprising: a relatively thin housing structure having spaced apart opposed side walls, a surrounding edge structure interconnecting said opposed side walls, an inner-partition wall that defines a pair of open cavities formed on opposite sides thereof with each cavity including a side brush opening formed with the surrounding edge structure; a pair of separate and independent carriers movably mounted between the opposed side walls and within respective open cavities formed within said housing structure, each carrier being movably mounted for back and forth sliding movement between retracted and extended positions; first brush means secured to an end of one of said carriers for particularly cleaning the head of an iron type golf club, said first brush means comprising a relatively hard brush for particularly engaging the head of an iron golf club and cleaning the same; second brush means secured to an end of the other carrier for cleaning the head of a wood type golf club, said second brush means including relatively soft brushes for particularly engaging and cleaning wood type golf club heads; a pair of elongated slots formed in said housing structure along one side wall, each elongated slot overlying one of the open cavities formed in the housing structure; a pair of slide studs fixed to respective carriers and extending upwardly therefrom through respective elongated openings formed in the housing structure and slidable back and forth therein, said slide studs being operative to move said carriers and associated brushes from the retracted position where the brushes are contained within said housing structure to an extended position where the brushes project outwardly from said side brush openings formed within the surrounding edge structure; and wherein each carrier and associated brush is contained within a respective cavity separate and distinct from the other carrier and its associated brush and wherein each carrier and brush is movable between the retracted and extended position independently of the carrier and its associated golf club head cleaning brush.

2. The dual golf club head cleaning brush apparatus of claim 1 wherein said first brush means comprises a brush assembly having brass cleaning elements.

3. The dual golf club head cleaning brush apparatus of claim 2 wherein said second brush means comprises relatively soft nylon type brush elements.

4. The dual golf club head cleaning brush apparatus of claim 2 wherein each cavity is of a generally closed rectangular shape having a single opening that forms said brush opening, and wherein the respective cavities are integrally formed and disposed in side by side relationship so as to form the dual brush cleaning apparatus.

* * * * *